US009997867B2

(12) United States Patent
Moriyasu et al.

(10) Patent No.: US 9,997,867 B2
(45) Date of Patent: Jun. 12, 2018

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Masanori Moriyasu, Mie (JP); Masaaki Tabata, Mie (JP); Hajime Matsui, Mie (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days. days.

(21) Appl. No.: 15/505,688

(22) PCT Filed: Aug. 31, 2015

(86) PCT No.: PCT/JP2015/074562

§ 371 (c)(1),
(2) Date: Feb. 22, 2017

(87) PCT Pub. No.: WO2016/043027

PCT Pub. Date: Mar. 24, 2016

(65) Prior Publication Data

US 2017/0288334 A1 Oct. 5, 2017

(30) Foreign Application Priority Data

Sep. 19, 2014 (JP) ..... 2014-190770

(51) Int. Cl.
*H01R 13/52* (2006.01)
*H01R 24/20* (2011.01)
*H01R 107/00* (2006.01)

(52) U.S. Cl.
CPC ..... *H01R 13/521* (2013.01); *H01R 24/20* (2013.01); *H01R 2107/00* (2013.01)

(58) Field of Classification Search
CPC .. H01R 13/4223; H01R 13/64; H01R 12/724; H01R 13/04; H01R 13/4361;
(Continued)

(56) References Cited

U.S. PATENT DOCUMENTS 7,112,067 B1 * 9/2006 Korsunsky et al. ... H01R 12/52 439/65
7,988,502 B2 * 8/2011 Nagano ..... H01R 13/424 439/595
(Continued)

FOREIGN PATENT DOCUMENTS

JP 55-92284 6/1980
JP 2002-75508 3/2002
(Continued)

OTHER PUBLICATIONS

International Search Report dated Nov. 24, 2015.

*Primary Examiner* — Truc Nguyen
(74) *Attorney, Agent, or Firm* — Gerald E. Hespos; Michael J. Porco; Matthew T. Hespos

(57) ABSTRACT

It is aimed to enable a short circuit in a retainer insertion hole to be avoided. Short-circuit preventing walls (18) configured to partition between cavities (11) adjacent in an arrangement direction are provided in a retainer insertion hole (15). A retainer (13) is provided with a plurality of frame-like portions (20) along the arrangement direction of the respective cavities (11). Each frame-like portion (20) is formed to be able to communicate with the corresponding cavity (11). Escaping grooves (32) are formed along a mounting direction of the retainer (13) between the frame-like portions (20) adjacent in the arrangement direction. Escaping grooves (32) are open on front end parts in the mounting direction of the retainer (13) such that the retainer (13) is mountable into the retainer insertion hole (15) while avoiding interference with the short circuit preventing walls (18).

2 Claims, 12 Drawing Sheets

(58) Field of Classification Search
CPC ..... H01R 13/4367; H01R 13/506; H01R 13/639; H01R 2107/00; H01R 12/721; H01R 13/4364; H01R 13/502; H01R 13/5208; H01R 13/6271
See application file for complete search history.

(56) References Cited

U.S. PATENT DOCUMENTS

| | | | | |
|---|---|---|---|---|
| 2002/0168896 | A1* | 11/2002 | Suzuki | H01R 13/4365 439/595 |
| 2003/0114037 | A1* | 6/2003 | Abe | H01R 13/6272 439/350 |
| 2004/0072461 | A1* | 4/2004 | Matsuda | H01R 4/48 439/329 |
| 2007/0093131 | A1 | 4/2007 | Takahashi et al. | |
| 2008/0081504 | A1* | 4/2008 | Kobayashi | H01R 13/6272 439/354 |
| 2011/0183551 | A1* | 7/2011 | Hirano | H01R 13/4361 439/752 |
| 2012/0214358 | A1 | 8/2012 | Takahashi et al. | |
| 2013/0052864 | A1* | 2/2013 | Kataoka | H01R 13/5208 439/587 |

FOREIGN PATENT DOCUMENTS

| | | |
|---|---|---|
| JP | 2007-115614 | 5/2007 |
| JP | 2011-165370 | 8/2011 |

* cited by examiner

CONNECTOR

BACKGROUND

1. Field of the Invention

The present invention relates to a connector.

2. Description of the Related Art

Japanese Unexamined Patent Publication No. 2002-75508 discloses a connector with terminal fittings accommodated into cavities of a connector housing and retained by locking lances formed in the cavities and a retainer mounted into the connector housing. The retainer is mounted into a retainer insertion hole formed open on a side surface of the connector housing. The retainer insertion hole is provided at intermediate positions of the cavities and formed from the cavities in an uppermost stage to those in a lowermost stage.

The connector housing described above has no partition wall for partitioning between the cavities in the retainer insertion hole and all of the cavities directly communicate. Thus, if water enters the retainer insertion hole, such as when terminal fittings having a potential difference are adjacent in a width direction, the terminal fittings adjacent in the width direction may be short-circuited through a clearance between the retainer and the connector housing.

The present invention was completed based on the above situation and aims to avoid a short circuit in a connector with a retainer to be mounted into a retainer insertion hole.

SUMMARY

The invention is directed to a connector with a connector housing that is connectable to a mating connector housing, and is formed internally with cavities configured to accommodate terminal fittings. The cavities are arranged in parallel in an arrangement direction intersecting a connecting direction. A side surface of the connector housing is formed with a retainer insertion hole communicating with the cavities. A retainer is capable of retaining and locking the terminal fittings by being mounted into the retainer insertion hole. Short circuit preventing walls are provided in the retainer insertion hole and partition between the cavities that are adjacent in the arrangement direction. The short circuit preventing walls are continuous with side walls of the respective cavities in the connecting direction. The retainer includes frame-like portions along the arrangement direction of the respective cavities. Each frame-like portion is formed to communicate with the corresponding cavity. Escaping grooves are formed along a mounting direction of the retainer between the frame-like portions that are adjacent in the arrangement direction. Each escaping groove is open on a front end part in the mounting direction of the retainer such that the retainer is mountable into the retainer insertion hole while avoiding interference with the short circuit preventing walls.

The retainer may be formed with a pressing portion configured to couple the respective frame-like portions on a rear end part in the mounting direction into the retainer insertion hole. Each pair of extended walls extends forward or rearward from both frame pieces located on opposite sides in the arrangement direction. Extending directions of the respective pairs of extended walls alternate in the arrangement direction, and end parts of the respective pairs of extended walls are connected to inner surface sides of a plurality of extended pressing portions connected to the pressing portion. Avoiding recesses are formed in an opening surface of the retainer insertion hole to expand the retainer insertion hole at front and rear alternate positions in the arrangement direction in correspondence with the respective extended pressing portions. The pressing portion and the extended pressing portions are alignable with and fittable into the retainer insertion hole and the avoiding recesses. Insertion grooves into which the respective extended walls are insertable are formed along the mounting direction of the retainer in places of the connector housing where the avoiding recesses are provided.

If the retainer is provided with no extended wall, only a relatively short creepage distance is ensured between the adjacent terminal fittings via clearances between the pressing portion and the short circuit preventing walls. However, by providing forward or rearward extended walls in the retainer as described above, the creepage distance between the adjacent terminal fittings can be increased at least either in a forward or rearward direction. Thus, a short circuit can be avoided more effectively.

Guiding portions may be formed on the front end part of the retainer in the mounting direction, an opening edge of the retainer insertion hole or opening edges of the avoiding recesses. The guiding portions may be configured to correct opening widths of front end sides of the escaping grooves in the mounting direction to a proper width by sliding in contact when the retainer is mounted. According to this configuration, the escaping grooves can be corrected to have a proper width and the short circuit preventing walls can be inserted smoothly therein by the action of the guiding portions, for example, if tip sides of the escaping grooves of the retainer are deformed in a widening direction.

According to the invention, the cavities adjacent in the arrangement direction are partitioned by the short circuit preventing walls in the retainer insertion hole. Thus, even if water enters the retainer insertion hole, a situation where the adjacent terminal fittings are short-circuited can be avoided.

DETAILED DESCRIPTION

Hereinafter, a specific embodiment of a connector of the present invention is described with reference to the drawings.

<Terminal Fittings 6>

Figure 9:
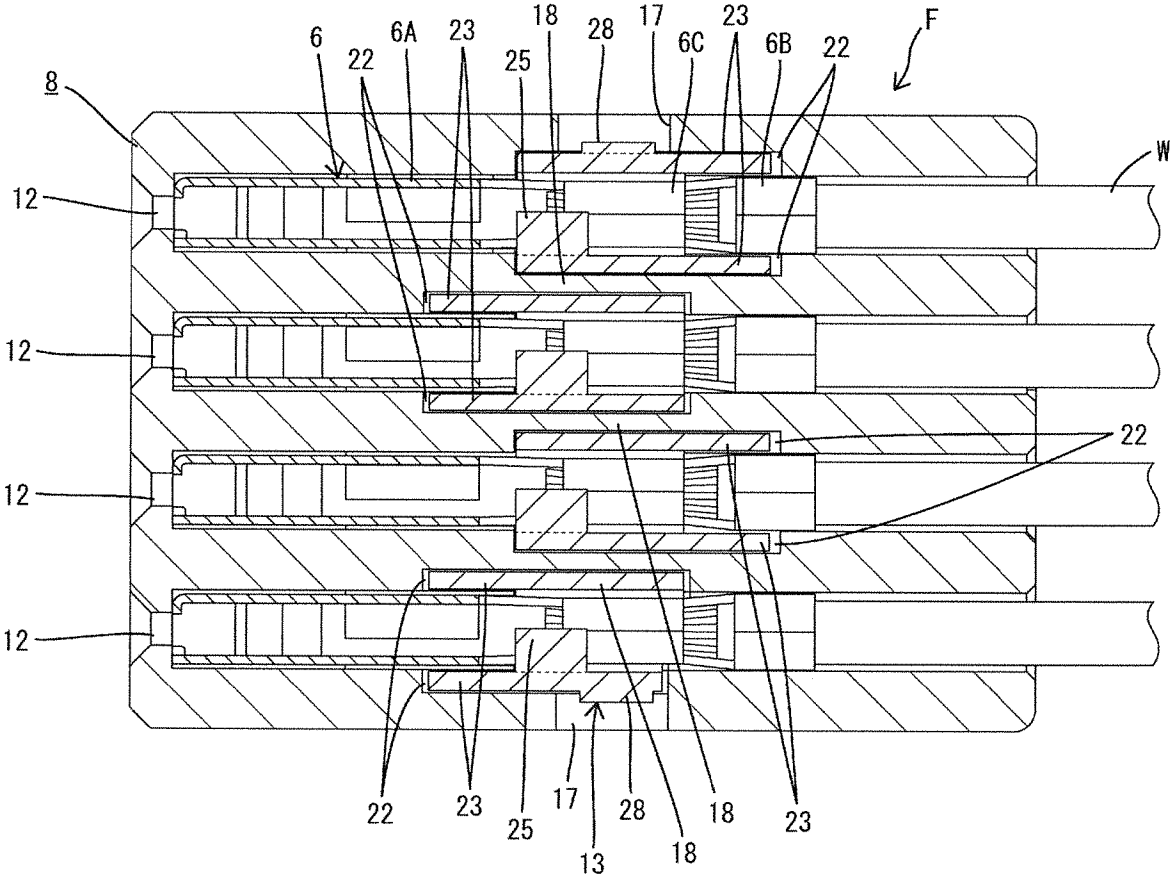
FIG. 9 is a plan view in section showing the fully locked state of the retainer.
Figure 10:
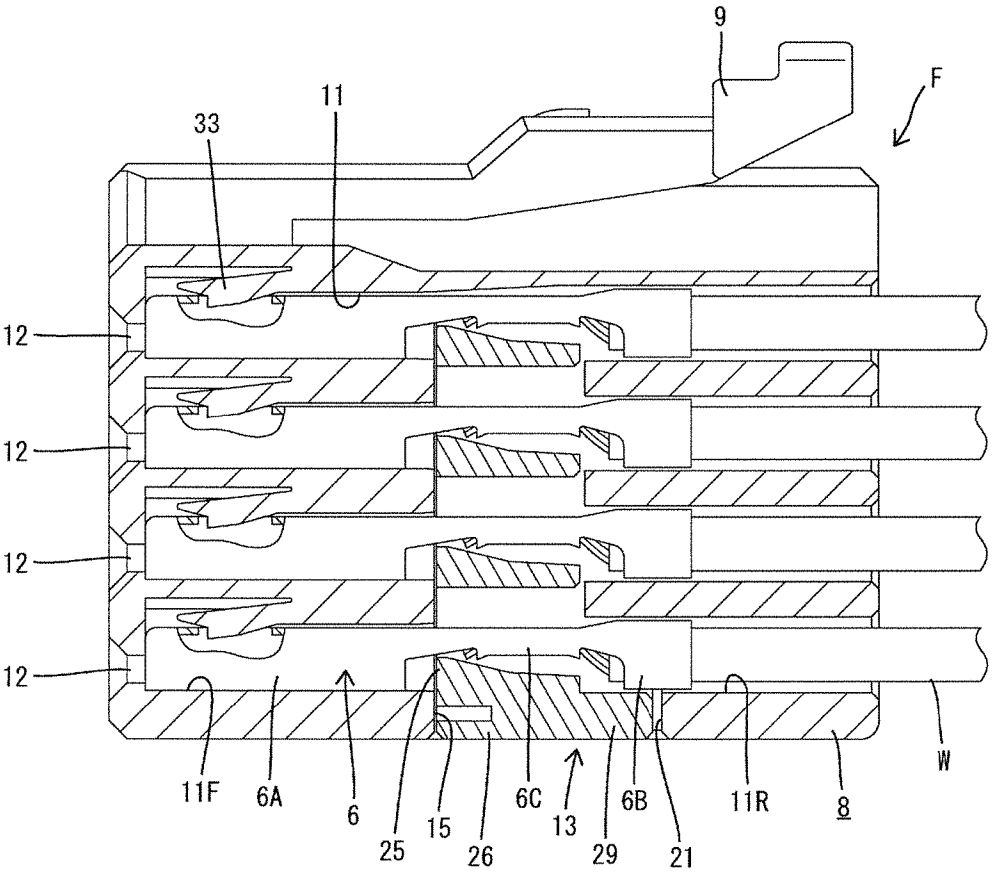
FIG. 10 is a side view in section showing the fully locked state of the retainer.
Figure 11:
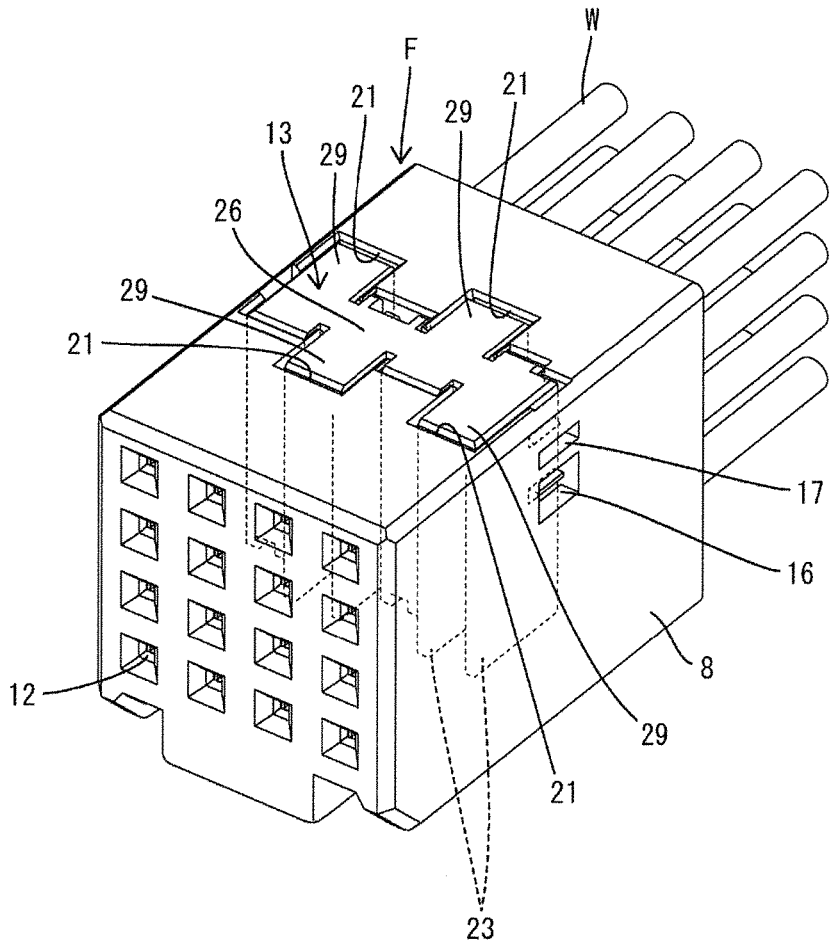
FIG. 11 is a perspective view showing the fully locked state of the retainer.

First, terminal fittings are described (see FIGS. 9 and 10). The terminal fitting 6 is mounted on an end part of each wire W. The terminal fitting 6 is formed by bending a plate material made of copper or copper alloy and a known female terminal fitting is used as such. Specifically, in the terminal fitting 6, a terminal connecting portion 6A in the form of a rectangular tube is formed in a front end part and an insulation barrel 6B to be crimped to an insulation coating of the wire W and a wire barrel 6C to be crimped to a core are formed behind the terminal connecting portion 6A as shown in FIG. 10 and the like.

<Female Connector Housing 8>

A connector housing 8 of a female connector in which each terminal fitting 6 is to be accommodated is described (see FIGS. 1 to 4). In the following description, terms relating to left, right, upper and lower sides are based on FIG. 1 and terms relating to front and rear sides correspond to a connecting direction of male and female connectors.

The female connector housing 8 is made of synthetic resin and in the form of a box. A deflectable lock arm 9 is formed on the upper surface of the female connector housing 8. The lock arm 9 locks the male and female connector housings 10, 8 in a connected state when the female connector F is connected properly to the male connector housing 10.

Figure 1:
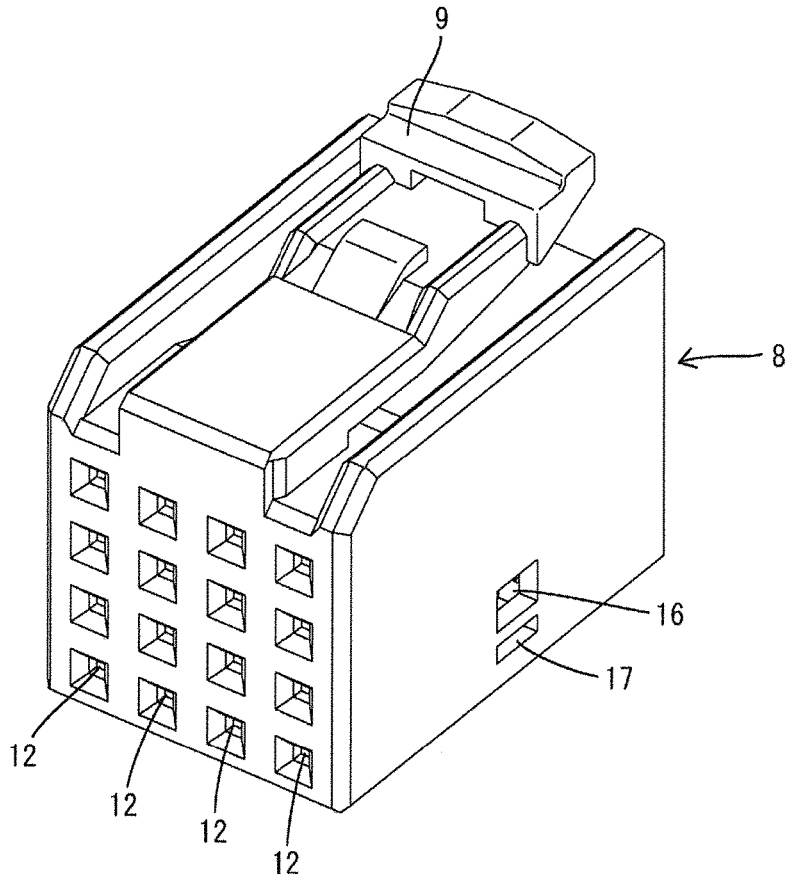
FIG. 1 is perspective view of a female connector housing.
Figure 4:
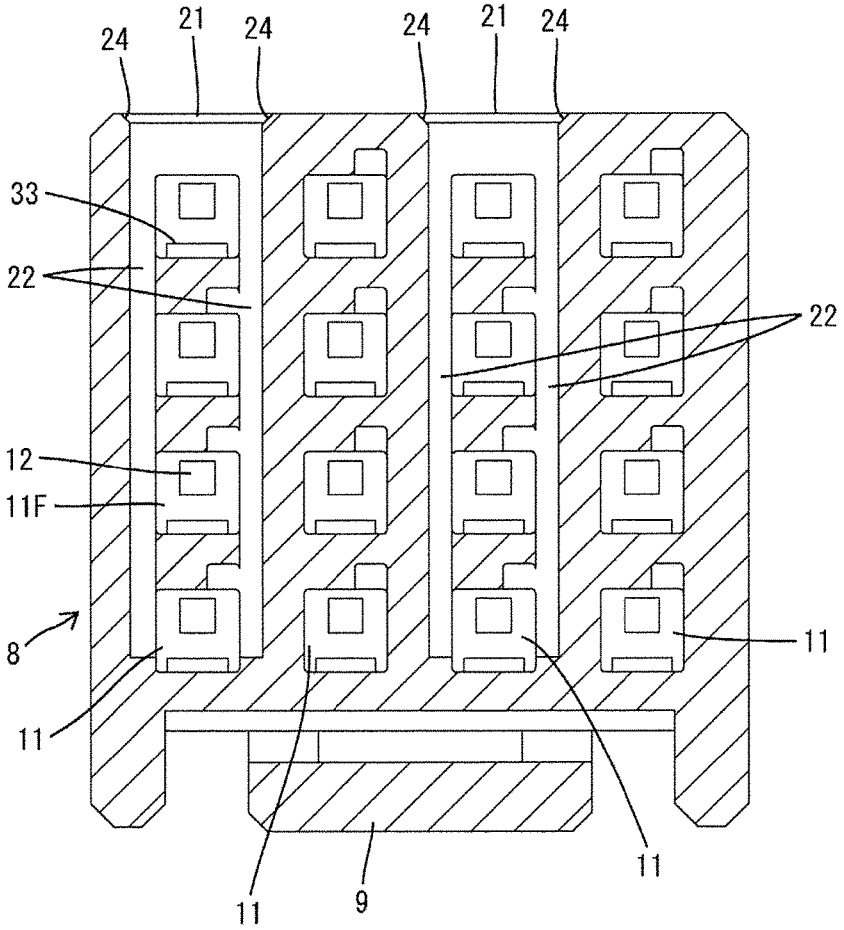
FIG. 4 is a section along A-A of FIG. 3.

Cavities 11 for accommodating the terminal fittings 6 are formed in the female connector housing 8. As shown in FIG. 1, four cavities 11 are arranged in parallel in each of a vertical direction and a lateral direction (arrangement direction). Each cavity 11 penetrates though the female connector housing 8 in a front-rear direction (connecting direction) and a terminal insertion hole 12 is open on a front surface (connection surface). Each cavity 11 has a substantially rectangular cross-section, as shown in FIG. 4. Specifically, each cavity 11 is surrounded by partition walls on four sides except in an area where a retainer 13 to be described later is to be mounted, thereby partitioning the cavities 11 adjacent in the vertical and lateral directions.

Figure 2:
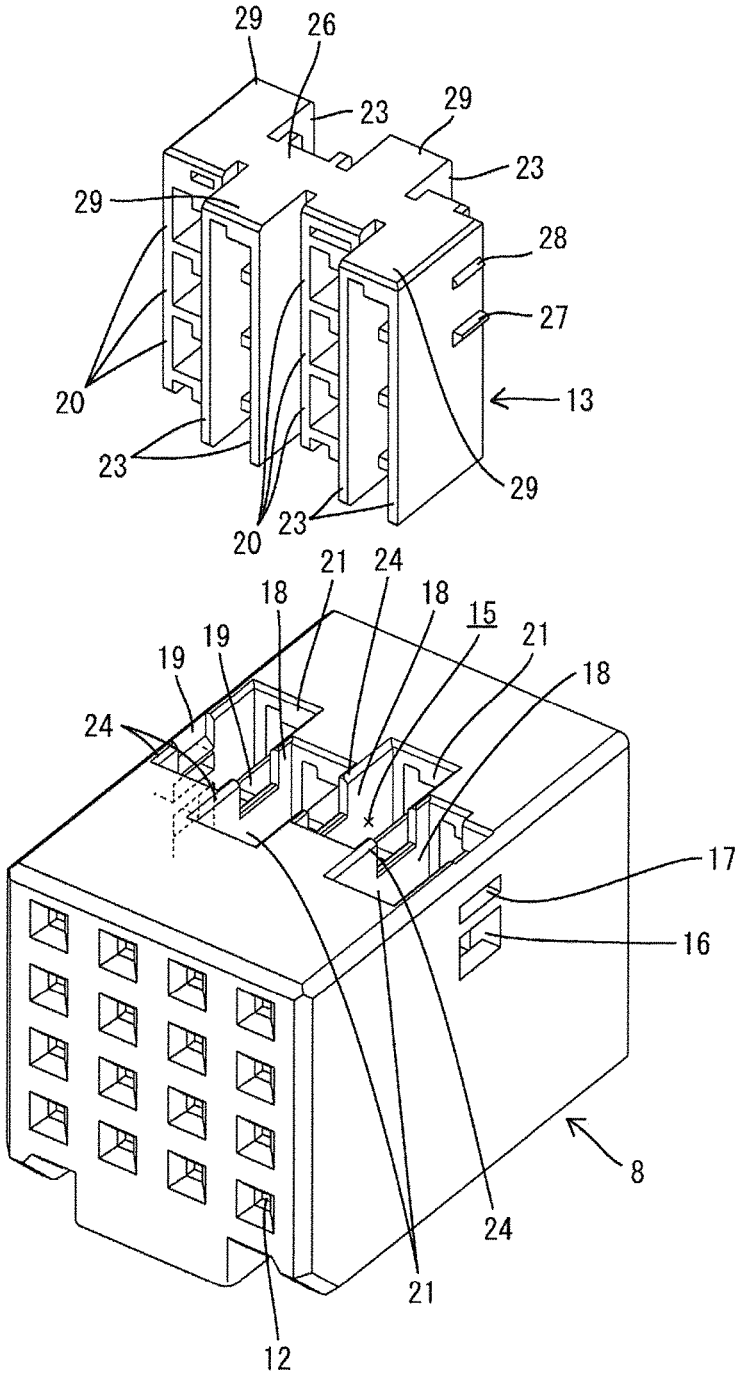
FIG. 2 is a perspective view of the female connector housing and a retainer when viewed from a lower surface side.

As shown in FIG. 2, the lower surface of the female connector housing 8 is recessed to form a retainer insertion hole 15 communicating with all the cavities 11. As shown in FIG. 10, each cavity 11 is divided into front and rear chambers 11F, 11R by the retainer insertion hole 15, and the terminal connecting portion 6A of the terminal fitting 6 is accommodated in the front chamber 11F. As shown in FIG. 10, the rear end positions of the respective terminal connecting portions 6A are substantially aligned in the front-rear direction in a state where the terminal fittings 6 are inserted to a proper depth in the cavities 11, and facing the retainer insertion hole 15 at a short distance from the retainer insertion hole 15. Further, a deflectable locking lance 33 is formed on the ceiling surface of this front chamber 11F and retains the terminal fitting 6 by locking the terminal connecting portion 6A. As shown in FIG. 10, a part of the terminal fitting 6 including the insulation barrel 6B and the wire W are accommodated in the rear chamber 11R of each cavity 11, and a part including the wire barrel 6C is positioned in a part of the cavity 11 corresponding to the retainer insertion hole 15.

As shown in FIGS. 1 and 2, a partial locking hole 16 and a full locking hole 17 are provided while being vertically spaced apart to penetrate through a part of each of both left and right side surfaces of the female connector housing 8 corresponding to an area where the retainer 13 is to be mounted.

Figure 3:
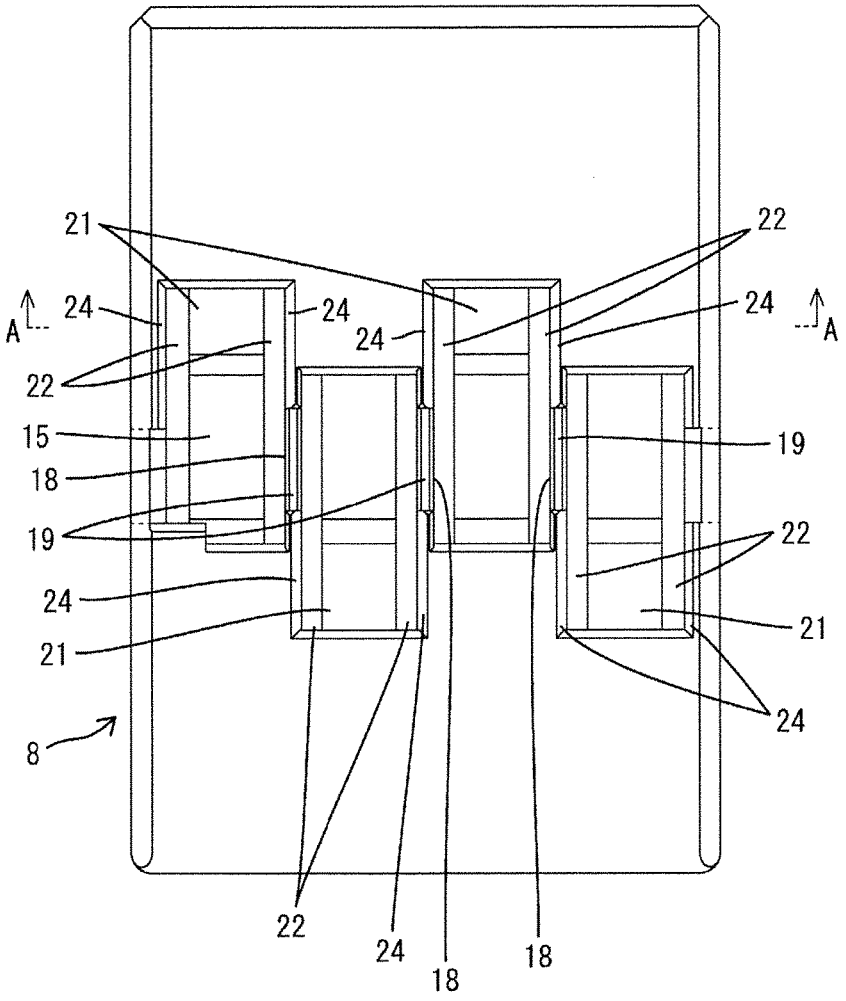
FIG. 3 is a bottom view of the female connector housing.

As shown in FIG. 2, the cavities 11 adjacent in the lateral direction are partitioned by short circuit preventing walls 18 in the retainer insertion hole 15. The short circuit preventing walls 18 couple both left and right side walls of the front and rear chambers 11F, 11R of the cavity 11 and have substantially the same wall thickness as the side walls. Further, as shown in FIG. 3, rectangular cut portions 19 are formed respectively in lengthwise central parts of end side walls of the cavities 11 located on both left and right end parts of the retainer insertion hole 15 and lower end edge parts of the respective short circuit preventing walls 18. Note that the respective cut portions 19 are for avoiding interference with parts coupling frame-like portions 20 constituting vertical rows in the retainer 13 when the retainer 13, to be described later, is mounted into the female connector housing 8.

Further, as shown in FIGS. 1 and 2, an opening surface of the retainer insertion hole 15 is formed on the lower surface of the female connector housing 8. This opening surface is formed so that front end positions and rear end positions are shifted alternately in correspondence with the cavities 11 adjacent in the lateral direction. That is, this opening surface is composed of areas (avoiding recesses 21) alternately expanding forward or rearward from a central area where each frame-like portion 20 of the retainer 13 is passed.

In the female connector housing 8, bottom walls of the corresponding cavities 11 are cut in parts where the avoiding recesses 21 are formed, and parts of ceiling walls of the cavities 11 are exposed to outside through the avoiding recesses 21 in a bottom view shown in FIG. 3. Thus, with the terminal fittings 6 accommodated in these cavities 11, rear parts of the terminal connecting portions 6A or parts including the insulation barrels 6B are located in the avoiding recesses 21. However, the cavities 11 adjacent in the lateral direction are partitioned by the partition walls constituting the cavities 11 also in the parts where the avoiding recesses 21 are formed.

Furthermore, as shown in FIGS. 3 and 4, two insertion grooves 22 are formed by cutting along the left and right partition walls of the respective cavities 11 arranged in the vertical direction to penetrate through the cavities 11 arranged in the vertical direction in the part of the female connector housing 8 where each avoiding recess 21 is formed. Two extending walls 23 formed in the retainer 13 to be described later are insertable into each pair of insertion grooves 22.

Tapered guiding surfaces 24 are inclined down toward an inner side at the opening edge of each avoiding recess 21 for guiding a mounting operation of the retainer 13.

<Retainer 13>

Figure 5:
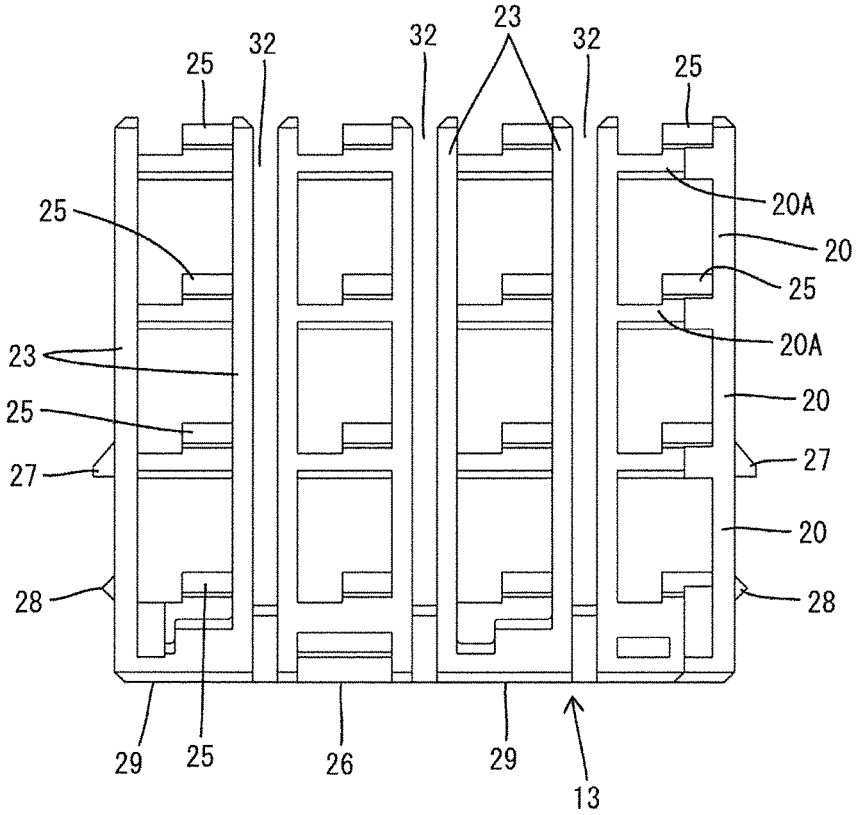
FIG. 5 is a front view of the retainer.
Figure 6:
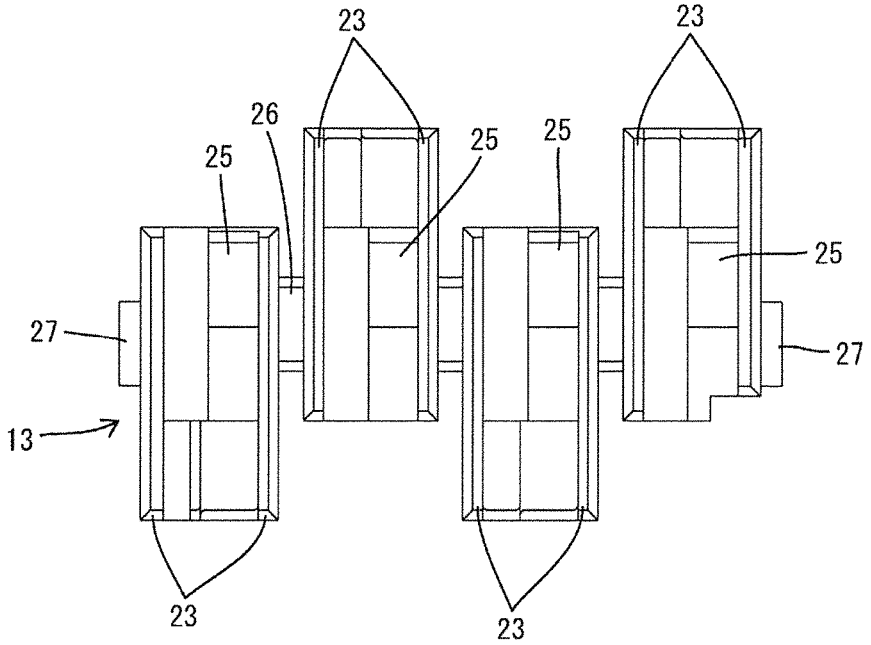
FIG. 6 is a bottom view of the retainer.

The retainer 13 also is formed integrally of synthetic resin. As shown in FIGS. 2 and 5, the retainer 13 includes a plurality of frame-like portions 20. The frame-like portions 20 are in the form of square frames capable of being aligned and communicating with the respective cavities 11. As shown in FIG. 5, four assemblies each including three frame-like portions 20 stacked in the vertical direction are provided in the lateral direction in the retainer 13 of this embodiment. One frame piece 20A of each frame-like portion 20 is provided with a locking protrusion 25. Locking protrusions 25 also are formed on the frame pieces 20A (uppermost frame pieces in FIG. 5) located on a front end part in a mounting direction of the retainer 13. As shown in FIG. 10, each locking protrusion 25 can lock the rear end of the terminal connecting portion 6A of the terminal fitting 6 when the retainer 13 is at a full locking position to be described later.

As shown in FIGS. 2 and 5, lower end parts in the mounting direction of the respective frame-like portions 20 arranged in the lateral direction are coupled by a pressing portion 26 in the form of a flat plate that is long in the lateral direction. As shown in FIG. 5, escaping grooves 32 for avoiding interference with the short circuit preventing walls 18 are provided between rows of the frame-like portions 20 provided by being coupled in the vertical direction. In this way, each row of the frame-like portions 20 of the retainer 13 has a cantilever structure with a free end on a front in the mounting direction.

Figure 7:
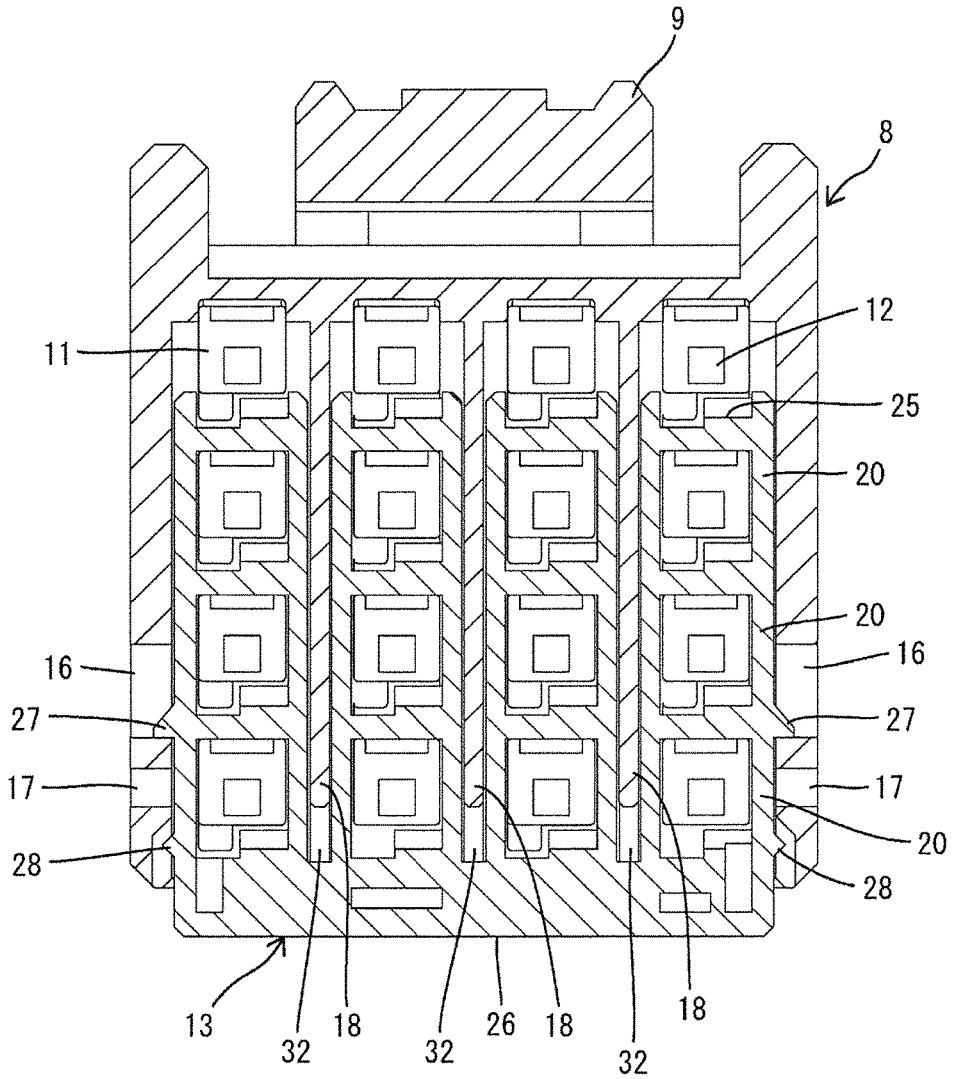
FIG. 7 is a front view in section showing a partially locked state of the retainer.

A first locking projection 27 and a second locking projection 28 are formed to project in parallel while being vertically spaced apart on each of opposite side surfaces of the retainer 13 in the lateral direction. The first locking projections 27 located on a front side in the mounting direction of the retainer 13 are locked to the partial locking holes 16 of the female connector housing 8 to hold the retainer 13 at a partial locking position with respect to the female connector housing 8 (see FIG. 7). When the retainer 13 is at the partial locking position, each frame-like portion 20 is substantially aligned with and communicates with the corresponding cavity 11 and each locking protrusion 25 is located outside an insertion path for the terminal fitting 6. This makes the terminal fitting 6 freely insertable into and withdrawable from the cavity 11. On the other hand, when the retainer 13 is inserted deeper into the retainer insertion hole 15, the first locking projections 27 are displaced in the partial locking holes 16, and the second locking projections 28 are locked into the full locking holes 17 to hold the retainer 13 at a full locking position with respect to the female connector housing 8 (state of FIG. 8). When the retainer 13 is at the full locking position, each locking protrusion 25 projects into the insertion path for the terminal fitting 6 and can be locked to the terminal connecting portion 6A of the terminal fitting 6.

Substantially square extended pressing portions 29 extend in a state substantially flush with front and rear edge parts of the pressing portion 26 in correspondence with the avoiding recesses 21 described above. Specifically, the respective extended pressing portions 29 extend from the pressing portion 26 alternately in opposite directions, i.e. forward or rearward with respect to the cavities 11 arranged in the lateral direction. When the retainer 13 is mounted in the fully locked state into the female connector housing 8, the pressing portion 26 is aligned with and closes the retainer insertion hole 15 and each extended pressing portion 29 is aligned with and closes the corresponding avoiding recess 21. At this time, the pressing portion 26 and each extended pressing portion 29 are substantially flush with the lower surface of the female connector housing 8.

Two extended walls 23 are provided continuously on an inner surface side of each extended pressing portion 29, and each has an extending width equal to a projecting width of the extended pressing portion 29 from the frame pieces 20A located on left and right sides of all the frame-like portions 20 constituting the vertical row. In other words, the extended walls 23 are formed over the entire height range of the retainer 13 while being spaced apart by a distance equal to the width of the corresponding extended pressing portion 29, and are formed by extending the left and right frame pieces 20A of the respective frame-like portions 20 constituting the vertical row forward or rearward with front end sides in the mounting direction of the retainer 13 as free ends. When the retainer 13 is mounted into the female connector housing 8, the extended walls 23 are inserted into the insertion grooves 22 and those of the extended walls 23 extending forward sandwich the rear end parts of the terminal connecting portions 6A of the corresponding terminal fittings 6 in the lateral direction, whereas those extending rearward sandwich the parts of the terminal fittings 6 substantially including the insulation barrels 6B in the lateral direction.

<Male Connector M>

Figure 12:
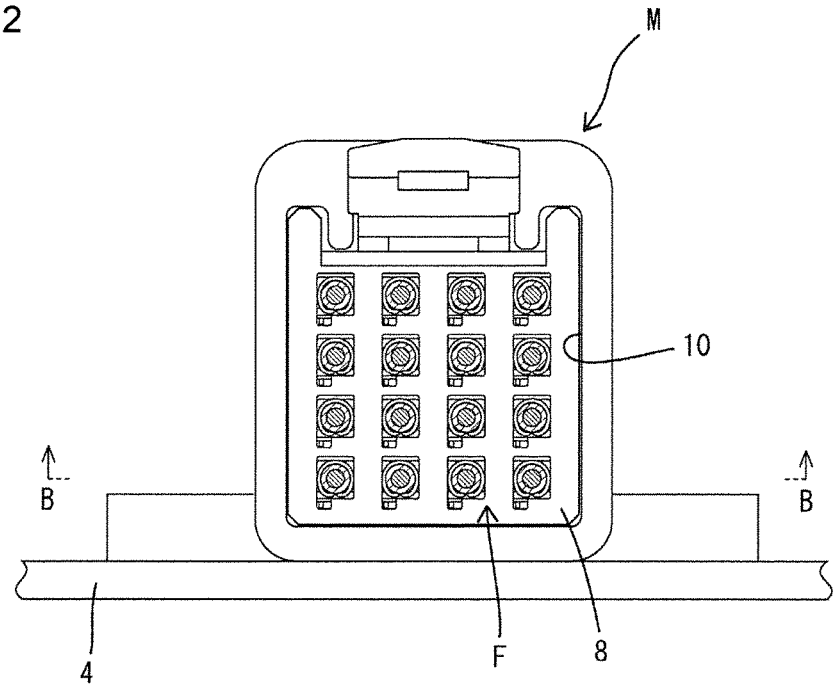
FIG. 12 is a front view showing a state where a female connector is connected to a male connector housing provided on a printed circuit board.
Figure 13:
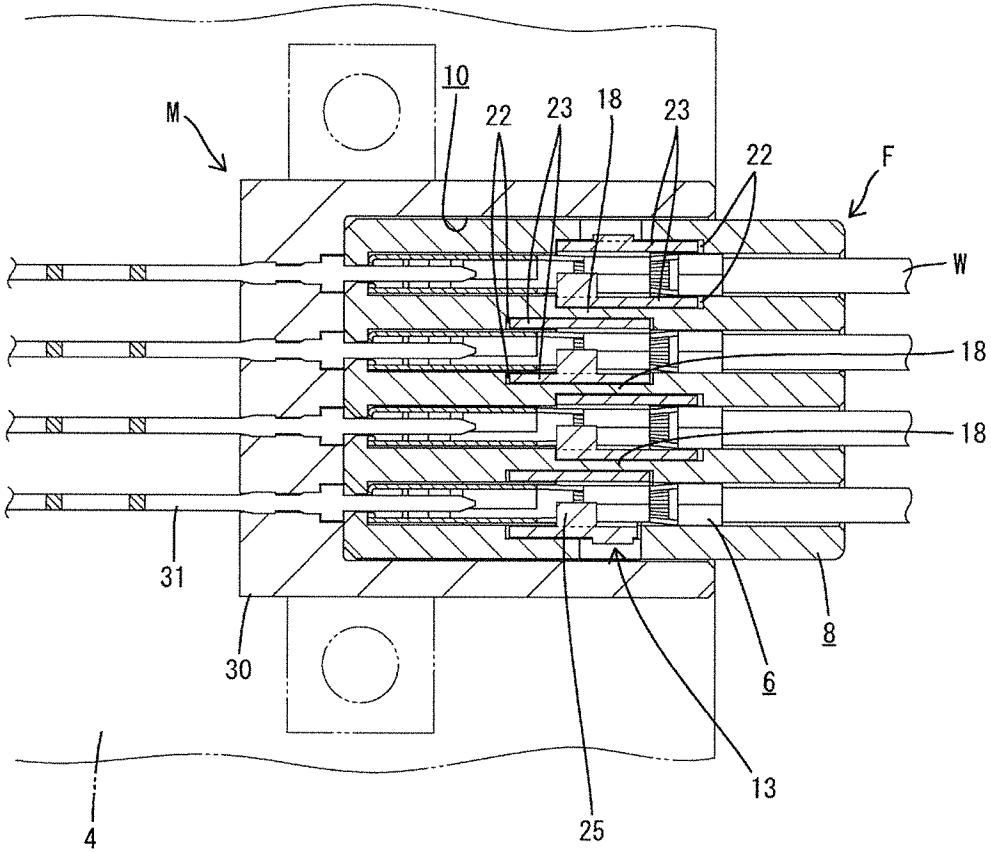
FIG. 13 is a section along B-B of FIG. 12.

A male connector M is provided on printed circuit board 4. As shown in FIG. 12, the male connector M includes the male connector housing 10. The male connector housing 10 is in the form of a rectangular tube open toward a connection surface side. The female connector housing 8 is fittable into the interior of the male connector housing 10. A lock receiving portion is formed at a position of a ceiling wall near the connection surface and can be locked to the lock arm 9 of the female connector F, although not shown in detail. Male terminal fittings 31 are arranged in the male connector housing 10 in accordance with the arrangement of the terminal fittings 6 (terminal connecting portions 6A) on the side of the female connector F. Each male terminal fitting 31 is a pin, pressed-fit through a back wall of the male connector housing 10 and drawn out to outside and an end part thereof is inserted into a corresponding through hole formed on the printed circuit board 4 after being bent substantially at a right angle. The part inserted into the through hole is soldered to be connected electrically to a conductive path formed on the printed circuit board 4.

Next, functions and effects of this embodiment configured as described above are described. In the case of assembling the female connector F, the retainer 13 first is mounted into the retainer insertion hole 15. The retainer 13 is aligned with the retainer insertion hole 15 while the retainer 13 is set in an orientation shown in FIG. 2. Thus, each extended pressing portion 29 and each avoiding recess 21 are positioned with respect to each other. The pressing portion 26 and the extended pressing portions 29 then are pressed to push the retainer 13 into the retainer insertion hole 15. During this time, even if a tip part of each escaping groove 32 is deformed to widen a spacing in the retainer 13, the front end part of the retainer 13 in the mounting direction slides in contact with the opening edge of the retainer insertion hole 15 and the guiding portions 24 formed on the opening edge of each avoiding recess 21 and the tip side of each escaping groove 32 is closed forcibly by the function of the tapered guiding portions 24. In this way, the escaping grooves 32 are fit tightly fit to the corresponding short circuit preventing walls 18 and each extended wall 23 is inserted into the corresponding insertion groove 22. Accordingly, the retainer 13 is first held at the partial locking position shown in FIG. 7.

In this state, each terminal fitting 6 is inserted into the corresponding cavity 11. If each terminal fitting 6 is inserted to a proper depth into the cavity 11, the terminal connecting portion 6A thereof is locked and retained by the locking lance 33.

Figure 8:
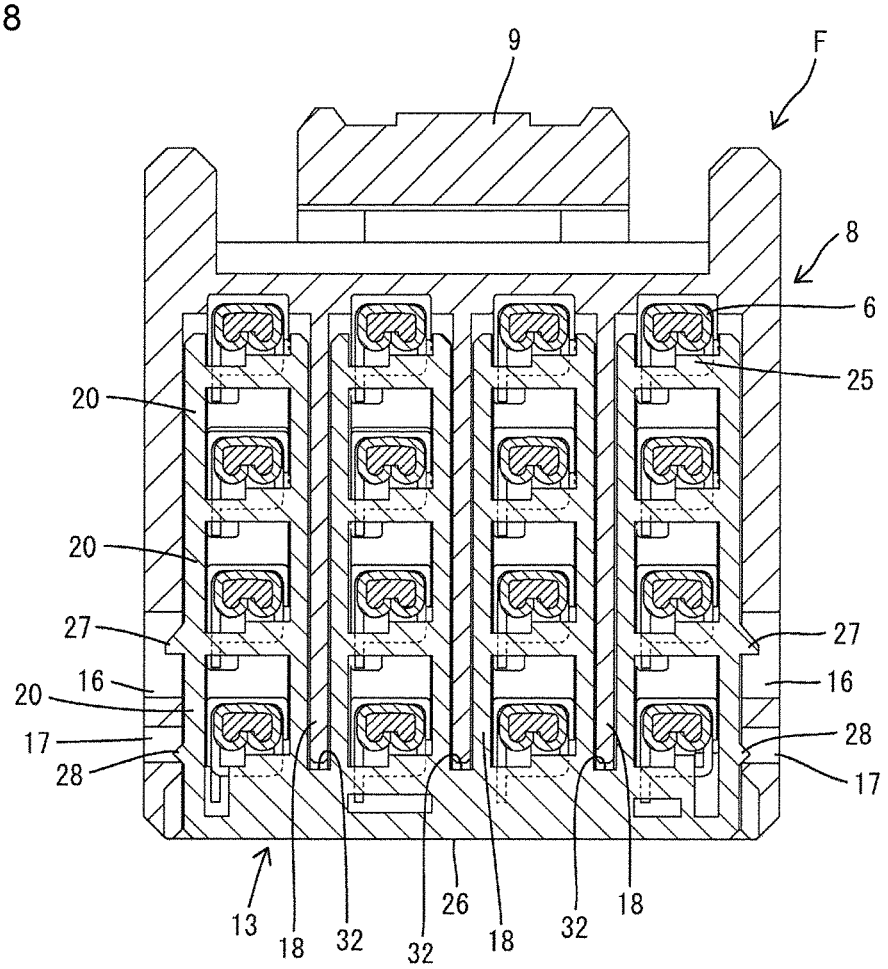
FIG. 8 is a front view in section showing a fully locked state of the retainer.

Subsequently, the retainer 13 is pushed farther and held at the full locking position shown in FIG. 8. At the full locking position, each locking protrusion 25 of the retainer 13 locks the rear end of the terminal connecting portion 6A of the terminal fitting 6 so that the terminal fitting 6 is retained doubly in conjunction with locking by the locking lance 33.

The female connector F that is assembled in the above way is fit into the male connector housing 10 of the male connector M. If the male and female connectors are connected properly, the lock arm 9 and the lock receiving portion are locked and the male and female connectors are locked in a connected state.

Water that enters through a clearance between the male and female connectors M, F may intrude into the inside through a clearance between the retainer 13 and the retainer insertion hole 15 (including the avoiding recesses 21). In this embodiment, even if such a situation occurs, a short circuit between the terminal fittings 6 adjacent in the lateral direction can be avoided effectively. Specifically, in this embodiment, the cavities 11 adjacent in the lateral direction are partitioned by the short circuit preventing walls 18 in the retainer insertion hole 15. Thus, a short circuit between the terminal fittings 6 that are adjacent in the lateral direction can be avoided effectively avoided.

Further, the retainer 13 of this embodiment is configured such that pairs of extended walls 23 extend alternately forward or rearward from the respective frame-like portions 20 constituting vertical rows. If a case is assumed where the retainer 13 including no extended wall 23 is mounted into the connector housing, a possibility of a short circuit between the terminal connecting portions 6A of the terminal fittings 6 adjacent in the lateral direction or parts from the wire barrels 6C to the insulation barrels 6B cannot be denied although this possibility is low since these terminal connecting portions 6A or the parts from the wire barrels 6C to the insulation barrels 6B are located at a relatively short electrical distance via the cut portions 19 of the short circuit preventing walls 18. However, the retainer 13 of this embodiment surrounds the terminal connecting portions 6A of the terminal fittings 6 adjacent in the lateral direction or the parts from the wire barrels 6C to the insulation barrels 6B with the pairs of extended walls 23. Thus, an electrical distance between the terminal fittings 6 adjacent in the lateral direction is increased by providing the extended walls 23, with the result that an occurrence of a short circuit can be avoided more reliably.

Furthermore, in this embodiment, the guiding portions 24 are formed on the opening edges of the avoiding recesses 21 and are brought into sliding contact with the front end part of the retainer 13 in the mounting direction when the retainer is mounted. Thus, even if the front end side of each escaping groove 32 is deformed and widened in the retainer 13, such a widening deformation can be corrected automatically in a narrowing direction so that the retainer 13 can be mounted smoothly.

The invention is not limited to the above described and illustrated embodiment. For example, the following embodiment also is included in the scope of the invention.

Although the retainer 13 is formed with the extended walls 23 and the extended pressing portions 29 and structured to alternately and repeatedly project forward and rearward in the lateral direction in the above embodiment, the retainer 13 may be flat in the lateral direction without being structured to project forward and rearward. In response to this, the retainer insertion hole 15 of the female connector housing 8 may be formed to have a uniform groove width (width in the front-rear direction) without including the avoiding recesses 21.

LIST OF REFERENCE SIGNS

6 . . . second terminal fitting (terminal fitting)
8 . . . female connector housing
11 . . . cavity
13 . . . retainer
15 . . . retainer insertion hole
18 . . . short circuit preventing wall
20 . . . frame-like portion
21 . . . avoiding recess
22 . . . insertion groove
23 . . . extended wall
24 . . . guiding portion
29 . . . extended pressing portion
32 . . . escaping groove

The invention claimed is:

1. A connector, comprising:

terminal fittings;

a housing that is connectable to a mating housing, the housing formed internally with cavities configured to accommodate the terminal fittings inserted in a connecting direction, the cavities being arranged in parallel columns that are spaced apart in an arrangement direction intersecting the connecting direction, side walls partitioning the cavities that are adjacent in the arrangement direction;

a retainer insertion hole formed in a side surface of the housing and communicating with the cavities, avoiding recesses formed in the side surface of the housing at positions aligned respectively with the columns of the cavities to expand the retainer insertion hole at front and rear alternate positions in the arrangement direction;

short circuit preventing walls provided in the retainer insertion hole and being continuous with the side walls of the respective cavities in the connecting direction to partition between the cavities that are adjacent in the arrangement direction; and a retainer having a pressing portion configured to fit in the retainer insertion hole in the side surface of the housing and including extended pressing portions configured to fit into the respective avoiding recesses when the pressing portion is fit in the retainer insertion hole, frames cantilevered from the pressing portion to extend along a mounting direction, the frames being spaced apart in the arrangement direction of the cavities, each frame communicating respectively with the cavities in a corresponding one of the columns of the cavities, extended walls extending forward or rearward from the respective frame and further extending in the mounting direction from a respective one of the extended pressing portions and dimensioned to be received in a corresponding one of the avoiding recesses; and escaping grooves formed along the mounting direction of the retainer between the frames that are adjacent in the arrangement direction, each of the escaping grooves is open on a front end part in the mounting direction of the retainer, wherein the retainer is mountable into the retainer insertion hole while avoiding interference with the short circuit preventing walls by fitting the short circuit preventing walls into the escaping grooves, and each of the short circuit preventing walls is sandwiched by the frames that are adjacent in the arrangement direction when the retainer is mounted.

2. The connector of claim 1, where guiding portions configured to correct opening widths of front end sides of the escaping grooves in the mounting direction to a proper width by sliding in contact when the retainer is mounted are formed on the front end part of the retainer in the mounting direction, an opening edge of the retainer insertion hole or opening edges of the avoiding recesses.

* * * * *